US005879166A

United States Patent [19]

Wang

[11] Patent Number: 5,879,166

[45] Date of Patent: Mar. 9, 1999

[54] COAXIAL CABLE CONNECTOR

[76] Inventor: Tsan-Chi Wang, 4th Floor, No. 8, Alley 8, Lane Ssu-Wei, Chung Cheng Rd., Hsin-Tien City, Taipei, Hsien, Taiwan

[21] Appl. No.: 855,979

[22] Filed: May 14, 1997

[30] Foreign Application Priority Data

Mar. 3, 1997 [TW] Taiwan ..... 86203215

[51] Int. Cl.[6] ..... H01R 9/09

[52] U.S. Cl. ..... 439/63; 439/581

[58] Field of Search ..... 439/63, 581

[56] References Cited

U.S. PATENT DOCUMENTS 5,044,990 9/1991 Knotts ..... 439/63

5,108,300 4/1992 Weber ..... 439/581

5,326,280 7/1994 Briones et al. ..... 439/581

*Primary Examiner*—Steven L. Stephan

*Assistant Examiner*—T C Patel

*Attorney, Agent, or Firm*—Fish & Richardson P.C.

[57] ABSTRACT

A coaxial cable connector including an electrically insulative base having at least one open chamber, and at least one jack respectively mounted in the at least one open chamber of the base and adapted to receive a respective coaxial cable, each jack including a metal cylindrical casing having a rear half mounted inside the base and a front half disposed outside the base, an insulative sleeve coaxially mounted inside the cylindrical casing, a signal terminal coaxially mounted inside the insulative sleeve and prohibited from contacting the cylindrical casing, and a grounding terminal mounted within the cylindrical casing outside the insulative sleeve and disposed in contact with the cylindrical casing.

4 Claims, 9 Drawing Sheets

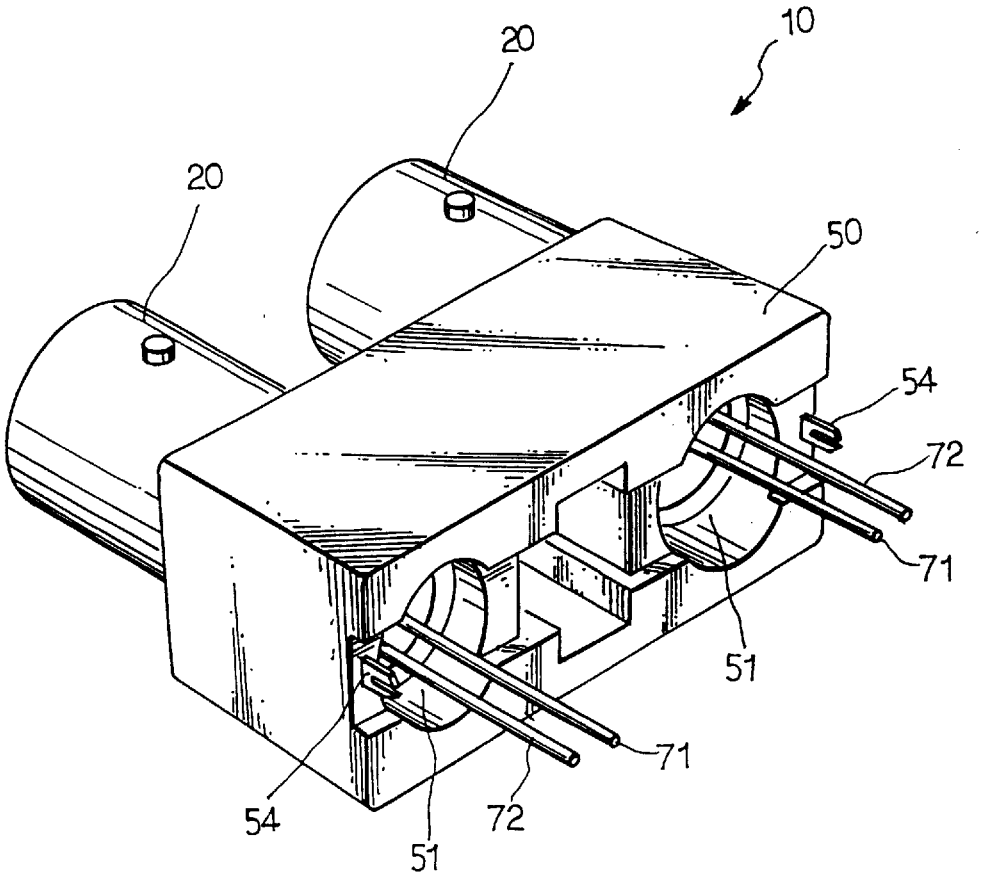
FIG.3-B

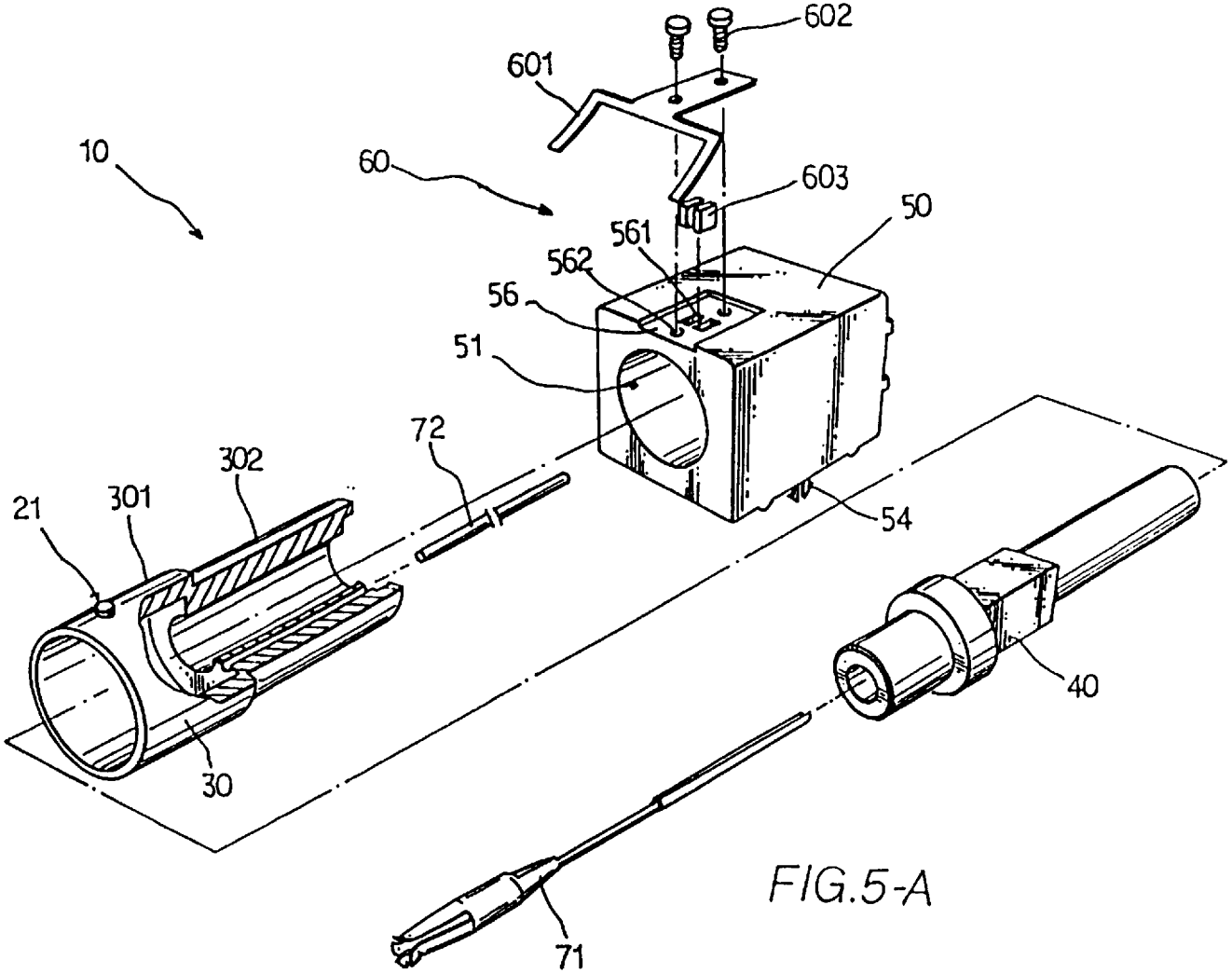
FIG.5-A

COAXIAL CABLE CONNECTOR

BACKGROUND OF THE INVENTION

The present invention relates to coaxial cable connectors, and more particularly to such a coaxial cable connector adapted for connecting a printed circuit board to a network cable system.

A regular coaxial cable connector 90, as shown in FIG. 1, comprises a base 92, a stepped, cylindrical metal casing 91 mounted in the base 92, an insulative sleeve 93 coaxially mounted within the metal casing 91, a signal terminal 94 coaxially mounted within the insulative sleeve 93, and a grounding terminal 95 mounted in the rear end of the metal casing 91. The base 92 has mounting rods 922 adapted for securing to a printed circuit board, a threaded coupling portion 921 raised from one side and adapted for fastening to for example a panel of a network board. In order to fit the design of the threaded coupling portion 921 of the base 92, the metal casing 91 has a certain length made in three steps. This design greatly increases the dimensions of the coaxial cable connector and its manufacturing cost.

SUMMARY OF THE INVENTION

According to the present invention, a coaxial cable connector comprises a base and one (or a plurality of jacks). Each jack comprises cylindrical metal casing mounted in the base, an insulative sleeve coaxially mounted within the metal casing, a signal terminal coaxially mounted within the insulative sleeve, and a grounding terminal mounted in the rear end of the metal casing. The base is made from electrically insulative material having at least one open chamber adapted to receive a respective jack. Unlike the prior art, the base does not have a threaded coupling portion, therefore the size of the coaxial cable connector can be greatly diminished.

BRIEF DESCRIPTION OF THE DRAWINGS

FIG. 2A is an elevational view of a TNC jack according to the present invention;

FIG. 3A is an elevational view of a coaxial cable connector according to a third embodiment of the present invention;

FIG. 3B is an elevational view of a coaxial cable connector according to a fourth embodiment of the present invention;

FIG. 5A is an exploded view in an enlarged scale of the coaxial cable connector shown in FIG. 5;

DETAILED DESCRIPTION OF THE PREFERRED EMBODIMENTS

Figure 1:
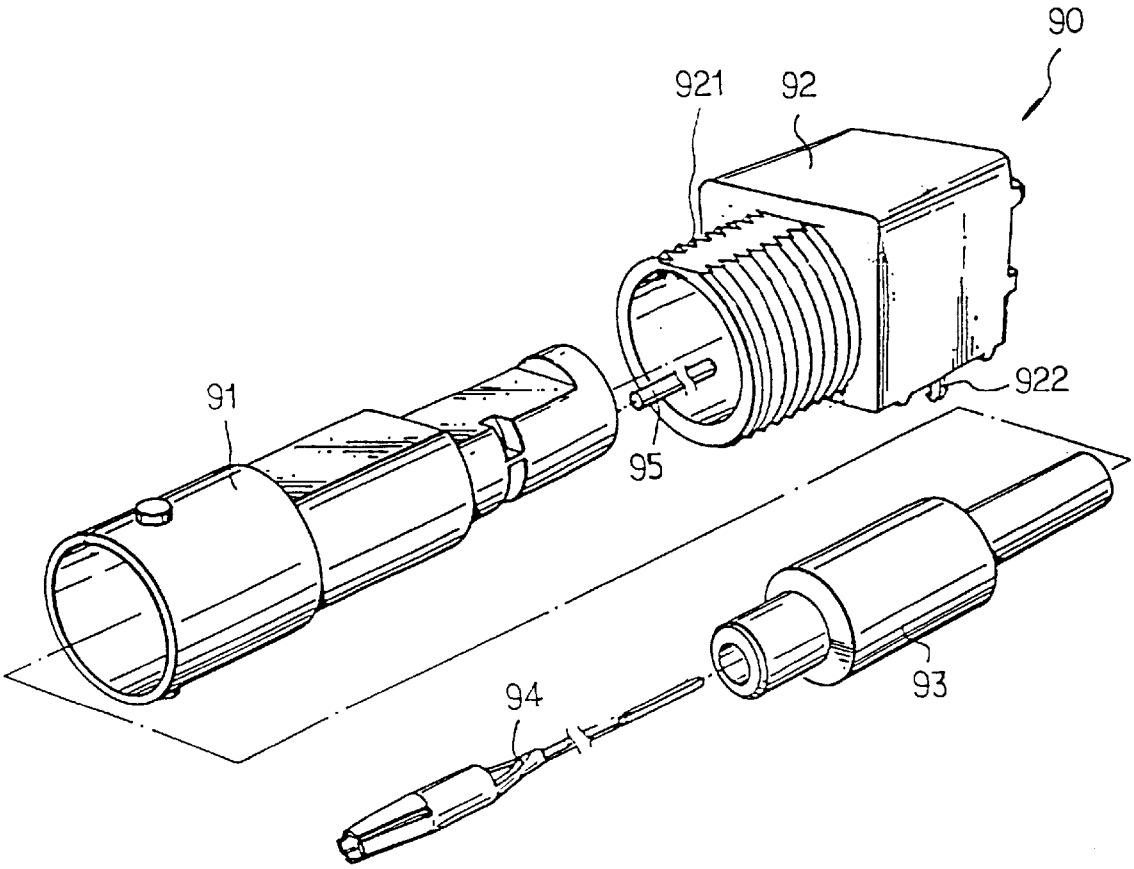
FIG.1 (Prior Art)
FIG. 1 is an exploded view of a coaxial cable connector according to the prior art.
Figure 2:
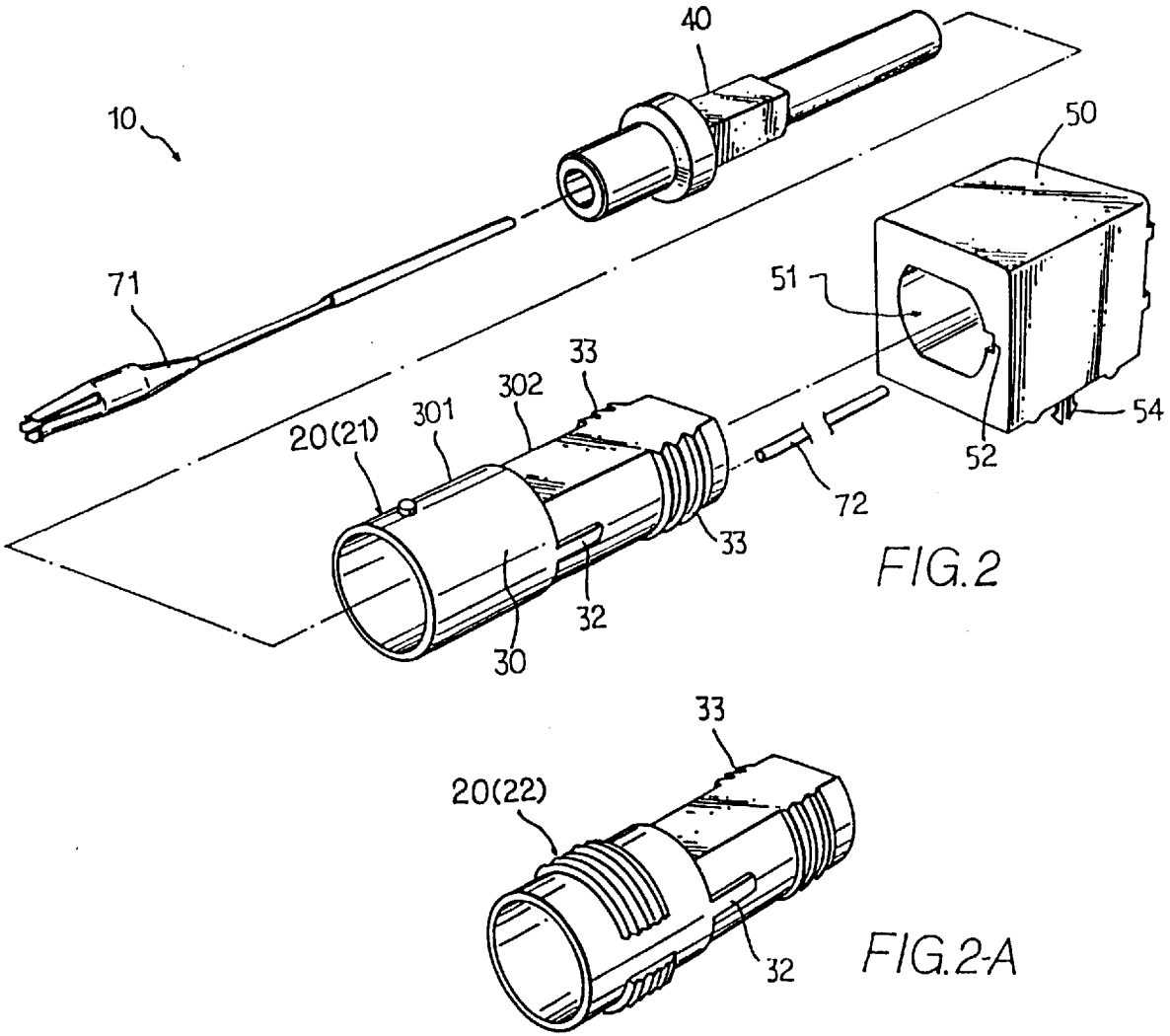
FIG. 2 is an exploded view of a coaxial cable connector according to a first embodiment of the present invention.
Figure 2B:
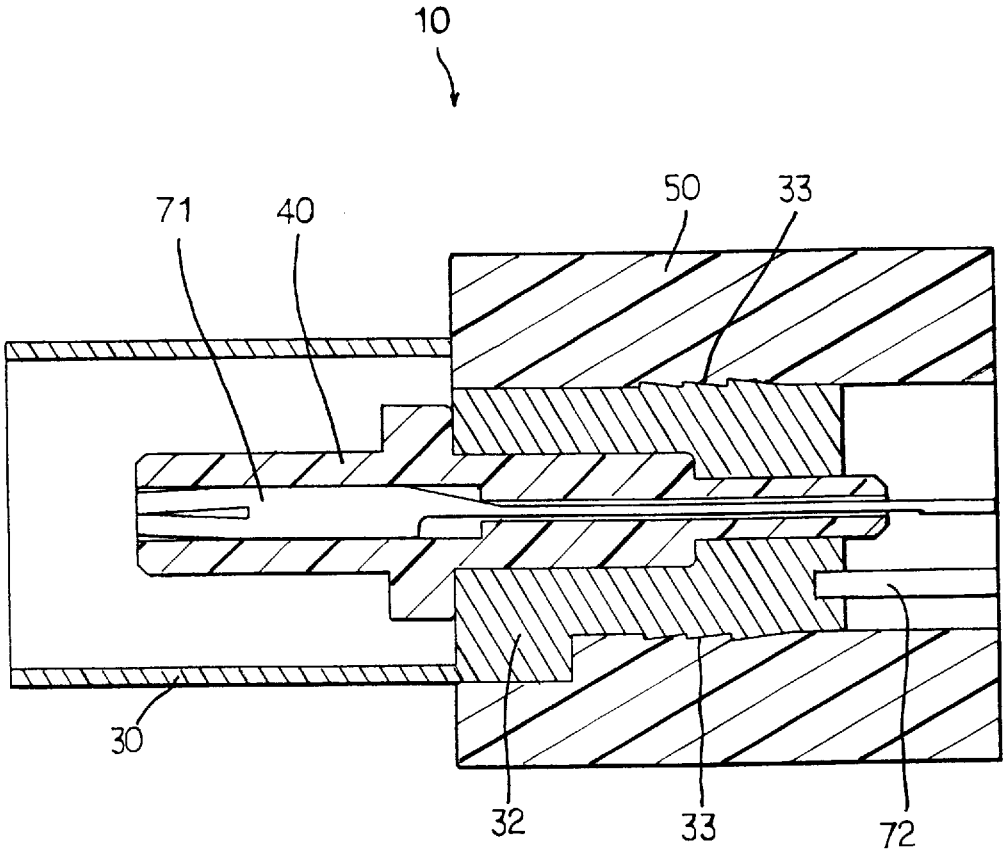
FIG. 2B is a cross-sectional side view of the coaxial cable connector of FIG. 2.

Referring to FIGS. 2 and 2A, a coaxial cable connector, referenced by 10, comprises a jack 20 which can be a BNC jack 21 (see FIG. 2) or TNC jack 22 (see FIG. 2A), and an electrically insulative mounting base 50. The Jack 21 or 22 comprises cylindrical casing 30 which is made from metal and comprised of a front half 301 and a rear half 302, an insulative sleeve 40 coaxially mounted inside the cylindrical casing 30, a signal terminal 71 coaxially mounted inside the insulative sleeve 40 within the cylindrical casing 30, and a grounding terminal 72 mounted inside the cylindrical casing 30 outside the insulative sleeve 40. The base 50 is a hollow rectangular block comprising an open chamber 51 which receives the rear half 302 of the cylindrical casing 30 of the jack 21 or 22, and a plurality of mounting rods 54 at its bottom side for fastening to a printed circuit board, and a female locating means for example a locating groove 52 within the open chamber 51. The rear half 302 of the cylindrical casing 30 comprises a male locating means for example a longitudinal locating rib 32 adapted to engage the locating groove 52 of the base 50 for quick positioning. Stop flanges 33 are provided at the periphery of the rear half 302 to prohibit a reverse movement of the cylindrical casing 30 in the open chamber 51 of the base 50 after the installation of the jack 21 or 22 in the base 50.

Figure 3:
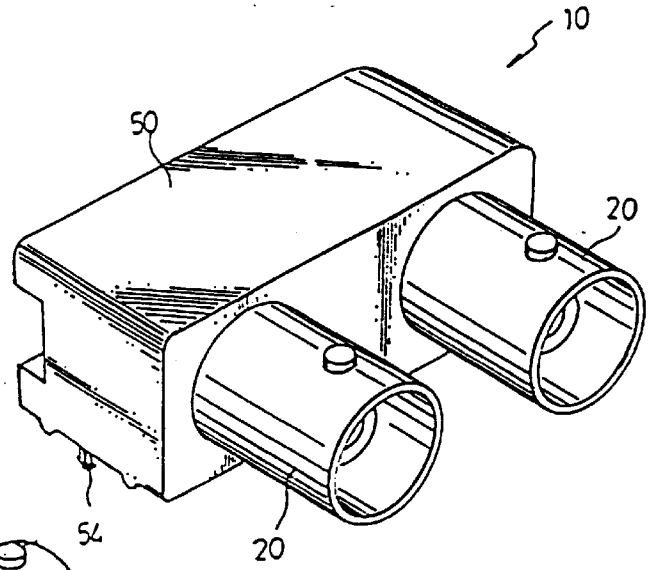
FIG. 3 is an elevational view of a coaxial cable connector according to a second embodiment of the present invention.

FIG. 3 shows a coaxial cable connector according to a second embodiment of the present invention. According to this alternate form, the coaxial cable connector 10 comprises two jacks 20 respectively mounted in a respective open chamber 51 in the base 50.

FIG. 3A shows a coaxial cable connector according to a third embodiment of the present invention. This embodiment is similar to that second embodiment shown in FIG. 3. However, the coaxial cable connector of the second embodiment is a horizontal type coaxial cable connector, and the coaxial cable connector of the third embodiment is a vertical type coaxial cable connector.

FIG. 3B shows a coaxial cable connector according to a fourth embodiment of the present invention. This embodiment is similar to the second embodiment shown in FIG. 3, however the mounting rods 54 of the fourth embodiment are disposed at the back side of the base 50, and the mounting rods 54 of the second embodiment are disposed at the bottom side. Of course, the signal terminal 71 and grounding terminal 72 must fit the locations of the mounting rods 54.

Figure 4:
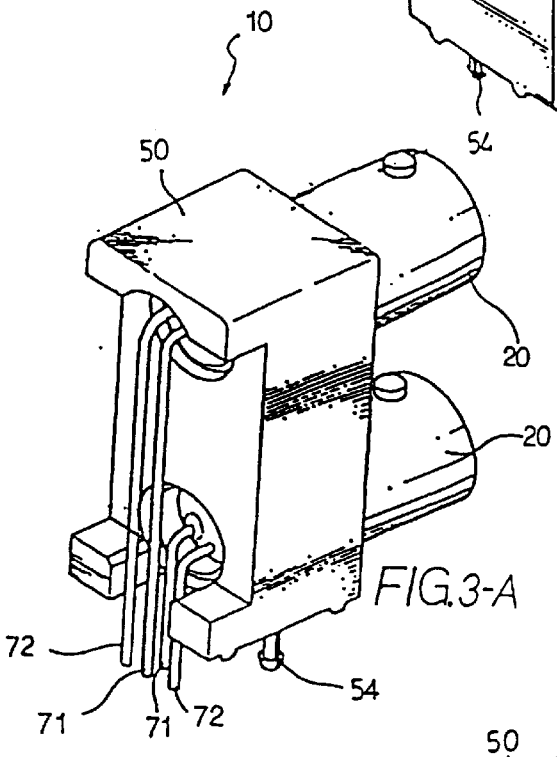
FIG. 4 is an elevational view of a coaxial cable connector according to a fifth embodiment of the present invention.
Figure 4:
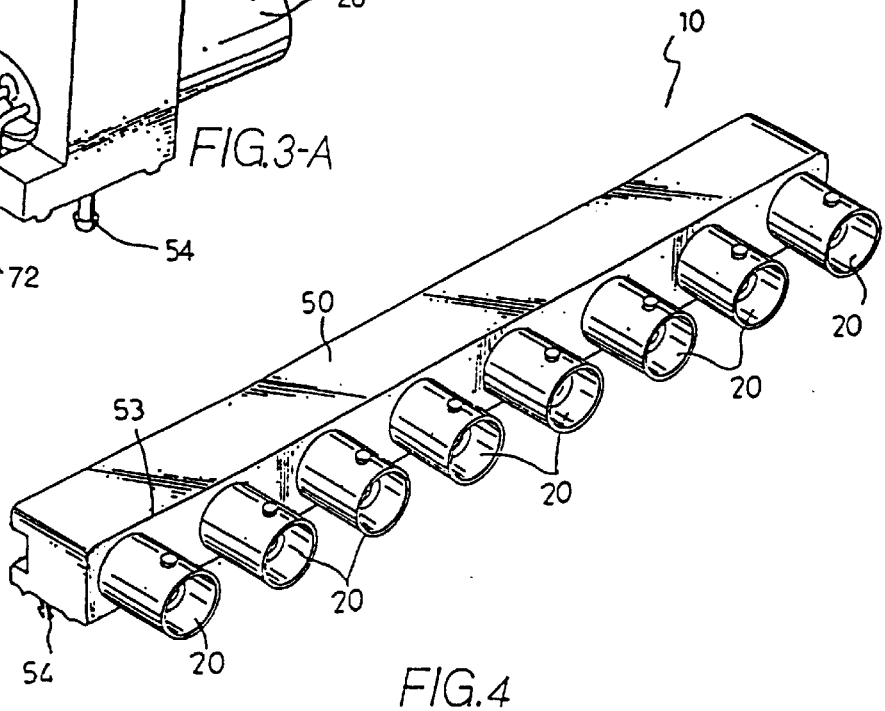

FIG. 4 shows a coaxial cable connector according to a fifth embodiment of the present invention. According to this alternate form, the coaxial cable connector 10 comprises a plurality of jacks 20 respectively mounted in the base 50 and arranged in a line.

Figure 5:
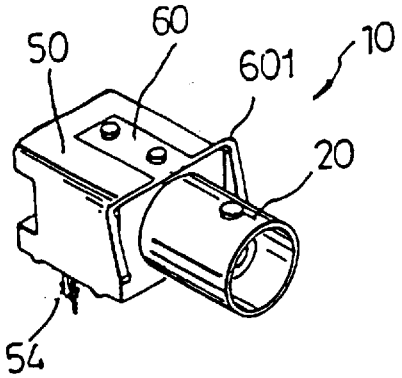
FIG. 5 is an elevational view of a coaxial cable connector according to a sixth embodiment of the present invention.

FIGS. 5 and 5A show a coaxial cable connector according to a sixth embodiment of the present invention. This embodiment is similar to the first embodiment of the present invention. However, the base 50 of the sixth embodiment of the present invention comprises a top recess 56, two capacitor holes 561 and two screw holes 562 in the top recess 56, and a filter 60 mounted in the top recess 56. The filter 60 is comprised of two capacitors 603 mounted in the capacitor holes 561 and held in close contact with the cylindrical casing 30 of the jack 21 by a clamping plate 601. The clamping plate 601 is fastened to the screw holes 562 of the base 50 by two screws 602 to hold down the capacitors 603, and adapted for securing to a panel of a circuit board (network board). The cylindrical casing 30 of the jack 21 of the six embodiment of the present invention eliminates the design of the aforesaid longitudinal locating rib 32 and stop flanges 33 from the cylindrical casing 30 and the design of the aforesaid locating groove 52 from the base 50.

Figure 6:
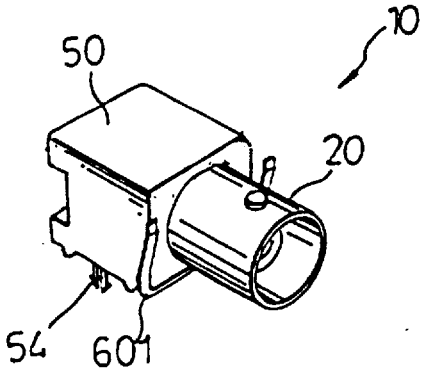
FIG. 6 is an elevational view of a coaxial cable connector according to a seventh embodiment of the present invention.

FIG. 6 shows a coaxial cable connector according to a seventh embodiment of the present invention. The only difference between the sixth embodiment and the seventh embodiment is at the location of the filter 60.

Figure 7:
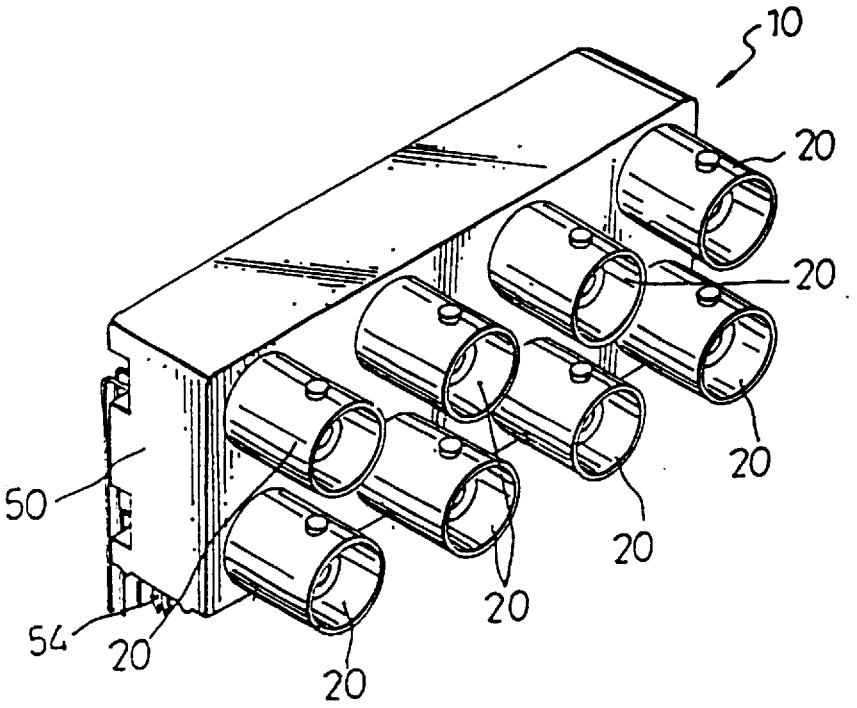
FIG. 7 is an elevational view of a coaxial cable connector according to a eighth embodiment of the present invention.

FIG. 7 shows a coaxial cable connector according to an eighth embodiment of the present invention. This embodiment is similar to the fifth embodiment of FIG. 4, however the jacks 20 of the eighth embodiment are arranged in two lines at different elevations while the jacks 20 of the fifth embodiment are arranged in a line.

Figure 8:
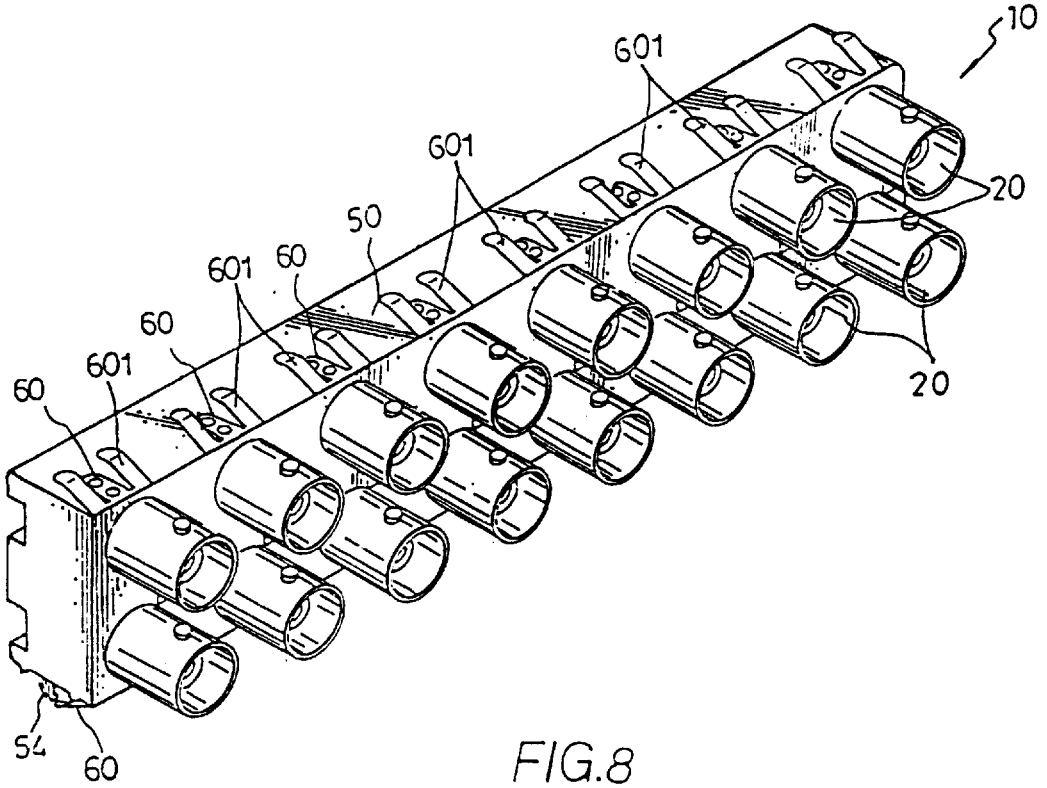
FIG. 8 is an elevational view of a coaxial cable connector according to a ninth embodiment of the present invention.

FIG. 8 shows a coaxial cable connector according to a ninth embodiment of the present invention. According to this embodiment, there are two rows of jacks 20 mounted in the base 50 at different elevations, each row including eight jacks 20, each jack 20 mounted with a respective filter 60.

Figure 9:
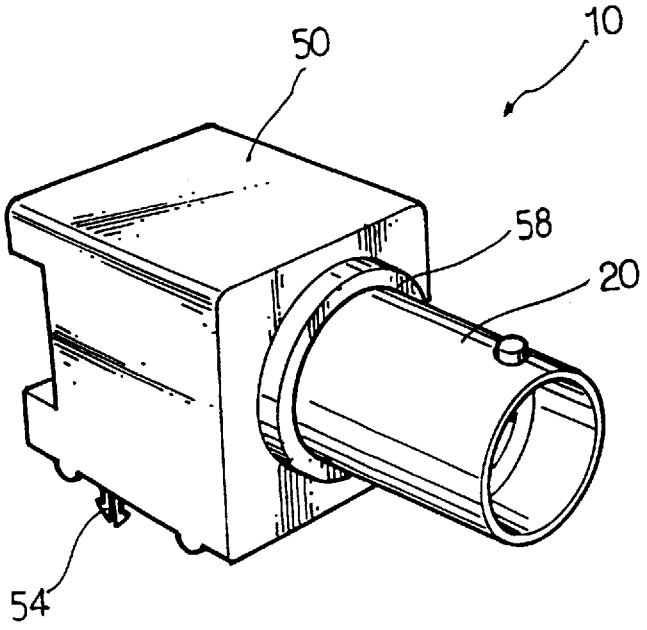
FIG. 9 is an elevational view of a coaxial cable connector according to a tenth embodiment of the present invention.

FIG. 9 shows a coaxial cable connector according to a tenth embodiment of the present invention. According to this embodiment, the base 50 comprises a mounting flange 58 raised around the jack 20 and adapted to be fitted into a mounting hole in a panel of a circuit board.

It is to be understood that the drawings are designed for purposes of illustration only, and are not intended as a definition of the limits and scope of the invention disclosed.

What the invention claimed is:

1. A coaxial cable connector comprising an electrically insulative base having at least one open chamber, and at least one jack mounted in the at least one open chamber of said base and adapted to receive a respective coaxial cable, each of said at least one jack comprising a metal cylindrical casing, an insulative sleeve coaxially mounted inside said cylindrical casing, a signal terminal coaxially mounted inside said insulative sleeve and prohibited from contacting said cylindrical casing, and a grounding terminal mounted within said cylindrical casing outside said insulative sleeve and disposed in contact with said cylindrical casing; wherein said cylindrical casing comprises a front half disposed outside said base, and a rear half mounted in one open chamber of said base; said base having a threadless outer surface wherein the rear half of said cylindrical casing includes flanges extending around a substantial portion of the periphery of the casing, the flanges inhibiting backward withdrawal of said cylindrical casing upon insertion in the corresponding open chamber of said base, said flanges being in the form of a series of ramp-shaped members, each ramp-shaped member having a first wall extending transversely relative to a longitudinal axis of the cylindrical casing and a second wall inclined toward the longitudinal axis.

2. The coaxial cable connector of claim 1, wherein said base is a substantially rectangular hollow shell.

3. The coaxial cable connector of claim 1, wherein said base comprises a plurality of mounting rods for fastening to a printed circuit board.

4. The coaxial cable connector of claim 1, wherein said base comprises a locating groove at each of its at least one open chamber; the cylindrical casing of each of said at least one connector comprises a longitudinal locating rib raised from the periphery and fitted into the locating groove of the corresponding open chamber in said base.

* * * * *